US011680585B2

(12) United States Patent
Takai et al.

(10) Patent No.: US 11,680,585 B2
(45) Date of Patent: Jun. 20, 2023

(54) VACUUM PUMP

(71) Applicant: Edwards Japan Limited, Chiba (JP)

(72) Inventors: Yoshiyuki Takai, Chiba (JP); Tooru Miwata, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 17/769,560

(22) PCT Filed: Oct. 27, 2020

(86) PCT No.: PCT/JP2020/040332
§ 371 (c)(1),
(2) Date: Apr. 15, 2022

(87) PCT Pub. No.: WO2021/090738
PCT Pub. Date: May 14, 2021

(65) Prior Publication Data

US 2022/0397124 A1 Dec. 15, 2022

(30) Foreign Application Priority Data

Nov. 5, 2019 (JP) ..... JP2019-200923

(51) Int. Cl.
*F04D 29/58* (2006.01)
*F04D 19/04* (2006.01)
(Continued)

(52) U.S. Cl.
CPC ..... *F04D 29/5853* (2013.01); *F04D 19/042* (2013.01); *F04D 29/522* (2013.01);
(Continued)

(58) Field of Classification Search
CPC ..... F04D 19/04; F04D 19/042; F04D 19/044; F04D 19/046; F04D 19/048; F04D 29/541; F04D 29/5893; F04D 29/5853
See application file for complete search history.

(56) References Cited

U.S. PATENT DOCUMENTS 6,217,278 B1 * 4/2001 Shiokawa ..... F04D 29/524 415/157

FOREIGN PATENT DOCUMENTS

JP H10306789 A 11/1998
JP 2004270692 A 9/2004
(Continued)

OTHER PUBLICATIONS

PCT International Search Report dated Dec. 28, 2020 for corresponding PCT application Serial No. PCT/JP2020/040332, 2 pages.
(Continued)

*Primary Examiner* — Christopher Verdier
(74) *Attorney, Agent, or Firm* — Theodore M. Magee; Westman, Champlin & Koehler, P.A.

(57) ABSTRACT

A vacuum pump includes a rotor provided with a plurality of rotor blades and a rotor cylinder portion, a driving portion, a bearing, stator blades, a thread groove stator that is disposed downstream of the stator blades and has an inner peripheral surface facing an outer peripheral surface of the rotor cylinder portion, and a heat insulating wall disposed downstream of the thread groove. The heat insulating wall includes a ring-shaped annular portion, and a substantially cylindrical wall portion extending from an inner portion of the annular portion in the radial direction to the upstream side and forming a flow path on the outer peripheral surface side. A first corner portion is formed between an upstream-side surface of the annular portion and the outer peripheral surface of the wall portion, the first corner portion being formed in an arc shape.

7 Claims, 7 Drawing Sheets

(51) Int. Cl.
*F04D 29/52* (2006.01)
*F04D 29/54* (2006.01)

(52) U.S. Cl.
CPC ..... *F04D 29/541* (2013.01); *F04D 29/542* (2013.01); *F04D 19/048* (2013.01)

(56) References Cited

FOREIGN PATENT DOCUMENTS

| | | | |
|---|---|---|---|
| JP | 2019090384 | A | 6/2019 |
| WO | 2019188732 | A1 | 10/2019 |

OTHER PUBLICATIONS

PCT International Written Opinion dated Dec. 28, 2020 for corresponding PCT application Serial No. PCT/JP2020/040332, 4 pages.

* cited by examiner

VACUUM PUMP

CROSS-REFERENCE OF RELATED APPLICATION

This application is a Section 371 National Stage Application of International Application No. PCT/JP2020/040332, filed Oct. 27, 2020, which is incorporated by reference in its entirety and published as WO 2021/090738A1 on May 14, 2021 and which claims priority of Japanese Application No. 2019-200923, filed Nov. 5, 2019.

BACKGROUND

The present invention relates to a vacuum pump, and particularly to a vacuum pump used in a semiconductor manufacturing apparatus, an analyzer, and the like.

In manufacturing a semiconductor device such as a memory or an integrated circuit, processing, such as film formation for forming an insulating film, a metal film, a semiconductor film, or the like, and processing of etching are performed. These processing operations are performed in a high vacuum chamber for the purpose of preventing the impact of dust and the like in the air. The chamber is connected to a vacuum pump in order to exhaust the gas introduced into the chamber to obtain a predetermined high degree of vacuum. Examples of a vacuum pump used include a composite pump in which a turbo-molecular pump and a thread groove pump are combined.

A vacuum pump in which a turbo-molecular pump and a thread groove pump are combined has the thread groove pump disposed on the downstream side of a turbo pump having rotor blades and stator blades arranged alternately in an axial direction, as disclosed in, for example, Japanese Patent Application Laid-open No. 2019-090384. The exhaust gas taken in from an inlet port is compressed by the turbo-molecular pump and the thread groove pump, and is discharged to the outside of the vacuum pump from an outlet port.

The thread groove pump includes a rotor cylinder portion that rotates and a thread groove stator on the casing side for accommodating a rotor. Thread grooves are formed on an opposed surface of the rotor cylinder portion or the thread groove stator. Accordingly, the gas can be transferred to the outlet port side by the rotation of the rotor cylinder portion inside the thread groove stator.

The exhaust gas behaves like a molecular flow in the turbo-molecular pump, and behaves like a viscous flow in the thread groove pump and a flow path downstream thereof due to a relatively high pressure therein. For this reason, by-products are likely to precipitate in a location where the flow of the exhaust gas stagnates in the thread groove pump and the flow path downstream thereof. Therefore, the thread groove stator is heated to a high temperature by a heater or the like so that the flow path is not blocked by the precipitation of by-products in the exhaust gas.

The by-products are generally chlorine-based or fluorine-based gas. The sublimation temperature of such gas increases as the degree of vacuum decreases and the pressure rises, causing the gas to easily solidify and accumulate inside the vacuum pump. The accumulation of the by-products inside the vacuum pump may narrow the flow path and consequently deteriorate the compression performance and exhaust performance of the vacuum pump.

On the other hand, a stator column, which encloses electrical components such as an electromagnet and a motor that drive the rotor to rotate, is cooled to a predetermined temperature or lower by a water cooling pipe or the like in order to prevent malfunction and deterioration of the performance of the electrical components. Therefore, if the flow path is formed between the heated high temperature portion and the cooled portion, the gas tends to precipitate as a by-product in the low temperature portion.

For this reason, apart of a low temperature member adjacent to the flow path downstream of the thread groove is covered with a high temperature heat insulating wall. The heat insulating wall restricts the exhaust gas downstream of the thread groove from coming into contact with the low temperature portion.

The discussion above is merely provided for general background information and is not intended to be used as an aid in determining the scope of the claimed subject matter. The claimed subject matter is not limited to implementations that solve any or all disadvantages noted in the background.

SUMMARY

A plurality of gas outlets for the thread groove pump are provided in a circumferential direction correspondingly to the number of threads of a screw. On the other hand, there is only one flow path leading to the outlet port. For this reason, the heat insulating wall is formed in a ring shape in order to transfer the gas to the outlet port provided at one location in the circumferential direction. If a recessed portion is formed on a surface of a ring-shaped heat insulating wall where the flow path is formed, a problem arises in which the flow of the gas stagnates and by-products easily precipitate and accumulate.

The present invention has been made in order to solve the foregoing problems, and an object thereof is to provide a vacuum pump capable of suppressing the precipitation and accumulation of by-products in a flow path downstream of a thread groove of the vacuum pump provided with the thread groove.

A vacuum pump according to the present invention that achieves the foregoing object includes a casing that includes an inlet port for drawing gas from outside or an outlet port for discharging the drawn gas to the outside, a rotor that is rotatably disposed in the casing and provided with a plurality of rotor blades and a rotor cylinder portion downstream of the plurality of rotor blades, a driving portion that drives the rotor to rotate, a bearing that rotatably supports the rotor, stator blades that are arranged so as to alternate with the plurality of rotor blades in an axial direction of the rotor, a thread groove stator that is disposed downstream of the stator blades and has an inner peripheral surface facing an outer peripheral surface of the rotor cylinder portion, and a heat insulating wall that is disposed downstream of a thread groove formed on the outer peripheral surface of the rotor cylinder portion or the inner peripheral surface of the thread groove stator, wherein the heat insulating wall includes a ring-shaped annular portion and a wall portion in a substantially cylindrical shape that extends from an inner portion of the annular portion in a radial direction to an upstream side and forms a flow path on an outer peripheral surface side, and a first corner portion is formed between an upstream-side surface of the annular portion and an outer peripheral surface of the wall portion, the first corner portion being formed in an arc shape in a cross section passing through a rotating shaft of the rotor.

In the vacuum pump according to the present invention that is configured as described above, since the first corner portion is formed in an arc shape, the gas flowing in the circumferential direction along the heat insulating wall downstream of the thread groove and flowing toward the outlet port is less likely to stagnate at the first corner portion. This makes it difficult for by-products to precipitate and accumulate in the first corner portion of the heat insulating wall. Consequently, this vacuum pump can suppress the precipitation and accumulation of by-products in the flow path downstream of the thread groove of the thread groove pump.

The wall portion may include a tubular wall portion having a substantially cylindrical shape, and a ring-shaped folded portion protruding outward in the radial direction from an upstream-side end portion of the tubular wall portion. Thus, it is possible to make the tubular wall portion thin while keeping the radial thickness of the folded portion at an appropriate length. By making the tubular wall portion thin, a wide flow path can be secured on the outer side of the tubular wall portion in the radial direction. Further, since the cross-sectional area of the tubular wall portion orthogonal to the rotating shaft of the rotor becomes small, the thermal resistance of the tubular wall portion increases, and it becomes difficult for heat to be transferred from the annular portion side to the folded portion. Therefore, the conduction of heat from the heat insulating wall to the rotor can be reduced by limiting the temperature rise of the folded portion.

In the cross section passing through the rotating shaft of the rotor, a second corner portion may be formed between an outer peripheral surface of the tubular wall portion and a downstream-side surface of the folded portion, the second corner portion having an arc shape. Therefore, the gas flowing in the circumferential direction along the heat insulating wall downstream of the thread groove and flowing toward the outlet port is less likely to stagnate at the second corner portion. This makes it difficult for by-products to precipitate and accumulate in the second corner portion of the heat insulating wall. Consequently, the vacuum pump can suppress the precipitation and accumulation of by-products in the flow path downstream of the thread groove pump.

The casing may include a passage formed downstream of the heat insulating wall and an outlet pipe having a substantially cylindrical shape in which the outlet port is formed, and an inner wall surface of the passage and an inner wall surface of the outlet pipe may be formed in a smooth, continuous manner. Therefore, the gas flowing toward the outlet port on the downstream side of the heat insulating wall is less likely to stagnate at an entrance of the outlet pipe. Consequently, this vacuum pump can suppress the precipitation and accumulation of by-products at the entrance of the outlet pipe in which the outlet port is formed.

The heat insulating wall may be disposed so as to cover a low temperature portion of the casing that is disposed downstream of the heat insulating wall and/or an inner side of the heat insulating wall in the radial direction and has a temperature lower than that of the heat insulating wall. Accordingly, the heat insulating wall can restrict the gas flowing toward the outlet port from coming into contact with the low temperature portion, suppressing the precipitation and accumulation of by-products in the low temperature portion.

The thread groove stator or a member coupled to the thread groove stator may include a heater, and the heat insulating wall may be coupled to the thread groove stator or the member coupled to the thread groove stator and having the heater disposed therein. Accordingly, the heat insulating wall can be heated, suppressing the precipitation and accumulation of by-products caused by a contact by the gas.

An upstream-side end surface of the wall portion may face a downstream-side end surface of the rotor cylinder portion in close proximity in the axial direction. Thus, the end surface of the heat insulating wall and the end surface of the rotor cylinder portion constitute a sealing structure. Therefore, the gas is less likely to leak from between the heat insulating wall and the rotor cylinder portion, and the precipitation and accumulation of by-products in a low temperature part can be suppressed.

In the heat insulating wall, a third corner portion may be formed between the inner peripheral surface of the thread groove stator or the member coupled to the thread groove stator and the upstream-side surface of the annular portion, the third corner portion being formed in an arc shape in the cross section passing through the rotating shaft of the rotor. Therefore, the gas flowing in the circumferential direction along the heat insulating wall downstream of the thread groove and flowing toward the outlet port is less likely to stagnate at the third corner portion. This makes it difficult for by-products to precipitate and accumulate in the third corner portion of the heat insulating wall. Consequently, this vacuum pump can suppress the precipitation and accumulation of by-products in the flow path downstream of the thread groove of the thread groove pump.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1:
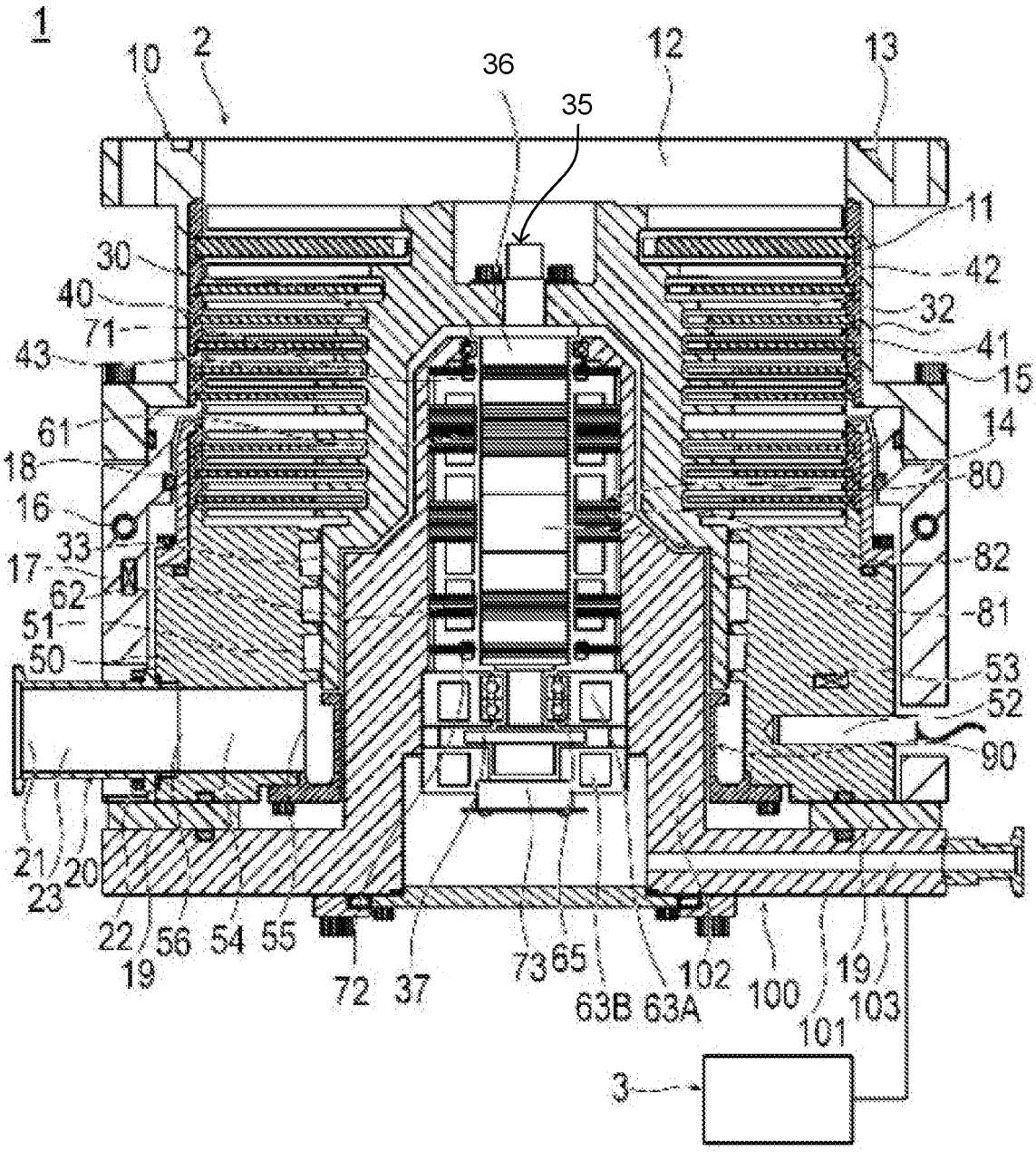
FIG. 1 is a cross-sectional view of a vacuum pump according to a first embodiment.

Embodiments of the present invention will be described hereinafter with reference to the drawings. The dimensions in the drawings may be exaggerated and differ from the actual dimensions for convenience of explanation. It should be noted, in the present specification and the drawings, that constituent elements with substantially identical functions and configurations are denoted by identical reference numerals, to omit redundant explanations. Note that, for the sake of convenience, the embodiments of the present invention each describe a diametrical direction of a rotor as "radial direction" and a direction perpendicular to the diametrical direction of the rotor as "axial direction."

First Embodiment

As illustrated in FIG. 1, a vacuum pump 1 according to a first embodiment of the present invention is a composite pump that includes a turbo-molecular pump that exhausts gas by repelling gas molecules by rotating a rotor 30 provided with rotor blades 32 at high speed, and a thread groove pump disposed on the downstream side of the turbo-molecular pump. The vacuum pump 1 includes a vacuum pump main body 2 for drawing and exhausting gas, and a controller 3 for controlling the vacuum pump main body 2.

The vacuum pump main body 2 draws gas from a chamber of, for example, a semiconductor manufacturing apparatus or an analyzer, and exhausts the gas. The vacuum pump main body 2 includes a stator portion 10 in which an inlet port 12 and an outlet port 21 are formed, the rotor 30 capable of rotating inside the stator portion 10, a bearing that supports the rotor 30 in a rotatable manner, a displacement sensor that detects a displacement of the rotor 30, and a motor 80 (driving portion) that drives the rotor 30 to rotate.

The stator portion 10 includes a casing 11 in which the inlet port 12 is formed, a stationary blade portion 40 in which stator blades 43 are provided, a water cooling spacer 14 coupled to the casing 11, a thread groove stator 50 in which a thread groove 51 is formed, an outlet pipe 20 in which the outlet port 21 is formed, and a base 100. The stator portion 10 further includes a heat insulating spacer 18 that insulates the thread groove stator 50 and the water cooling spacer 14, a heat insulating material 19 that insulates the thread groove stator 50 and the water cooling spacer 14 from the base 100, and a heat insulating wall 90 provided on the downstream side of the thread groove 51.

The casing 11 includes a flange 13 attached to the chamber of the semiconductor manufacturing apparatus or the like, and the inlet port 12 communicating with the chamber.

The stationary blade portion 40 is disposed inside the casing 11. The stationary blade portion 40 includes multiple stages of stators 41 and a plurality of stator spacers 42 stacked so as to sandwich the stator 41 of each stage. The respective stators 41 have a plurality of stator blades 43. The stator blades 43 are formed so as to be inclined at a predetermined angle from a plane perpendicular to an axial direction of a shaft 35. The stator blades 43 are arranged so as to alternate with the stages of rotor blades 32. An outer peripheral end portion of each stator blade 43 is sandwiched and supported between the plurality of stacked ring-shaped stator spacers 42. The stator spacers 42 are stacked and arranged inside the casing 11. The stator blades 43 constitute the turbo-molecular pump together with the rotor blades 32 of the rotor 30 described hereinafter.

The water cooling spacer 14 is formed in a substantially cylindrical shape and disposed on the downstream side of the casing 11. The water cooling spacer 14 is coupled to the casing 11 by a bolt 15. A water cooling pipe 16 and a first temperature sensor 17 are embedded in the water cooling spacer 14. The first temperature sensor 17 detects the temperature of the water cooling spacer 14 in order to adjust the temperature of the water cooling spacer 14. The water cooling pipe 16 controls the flow of cooling water in order to adjust the temperature of the water cooling spacer 14. Therefore, the water cooling spacer 14 is kept at a predetermined temperature (for example, 50° C. to 100° C.)

The thread groove stator 50 is formed in a substantially cylindrical shape and disposed inside the water cooling spacer 14, with a gap therebetween for the purpose of heat insulation from the water cooling spacer 14. The thread groove stator 50 is configured to be heated in order to suppress the precipitation and accumulation of by-products in the thread groove 51. A heat insulating material may be disposed between the water cooling spacer 14 and the thread groove stator 50.

The thread groove 51 in a spiral shape is formed on an inner peripheral surface of the thread groove stator 50. Furthermore, the thread groove stator 50 is provided with a cartridge heater 52 (heater) as a heating means, and a second temperature sensor 53 for detecting the internal temperature of the thread groove stator 50. In the present embodiment, the thread groove 51 is formed on the inner peripheral surface of the thread groove stator 50. However, on the contrary, a thread groove may be formed on an outer peripheral surface of the rotor cylinder portion 33.

The direction of the spiral of the thread groove 51 is a direction in which gas molecules are transferred toward the outlet port 21 when moving in a direction of rotation of the rotor 30. The thread groove stator 50 and the rotor cylinder portion 33 constitute the thread groove pump. The thread groove stator 50 is made of a metal such as aluminum, stainless steel, copper, iron, or an alloy containing these metals. For example, the thread groove stator 50 is made of aluminum. In the present embodiment, the thread groove stator 50 is made of a material having high thermal conductivity because the cartridge heater 52 is disposed as a heating means. However, in a case where the thread groove stator 50 has a different configuration from a member (heater spacer) provided with the cartridge heater 52 as a heating means, said member provided with the cartridge heater 52 may be made of a material having high thermal conductivity (for example, aluminum), and the thread groove stator 50 may be made of a high-strength material (for example, stainless steel) in order to ensure the strength at a high temperature.

The second temperature sensor 53 detects the temperature of the thread groove stator 50 in order to adjust the temperature of the thread groove stator 50. The cartridge heater 52 is housed in the thread groove stator 50. The cartridge heater 52 generates heat when energized and adjusts the temperature of the thread groove stator 50. The cartridge heater 52 is controlled to supply electric power based on the result detection by of the second temperature sensor 53. Therefore, the thread groove stator 50 is kept at a predetermined temperature (for example, 100° C. to 150° C.).

Figure 2:
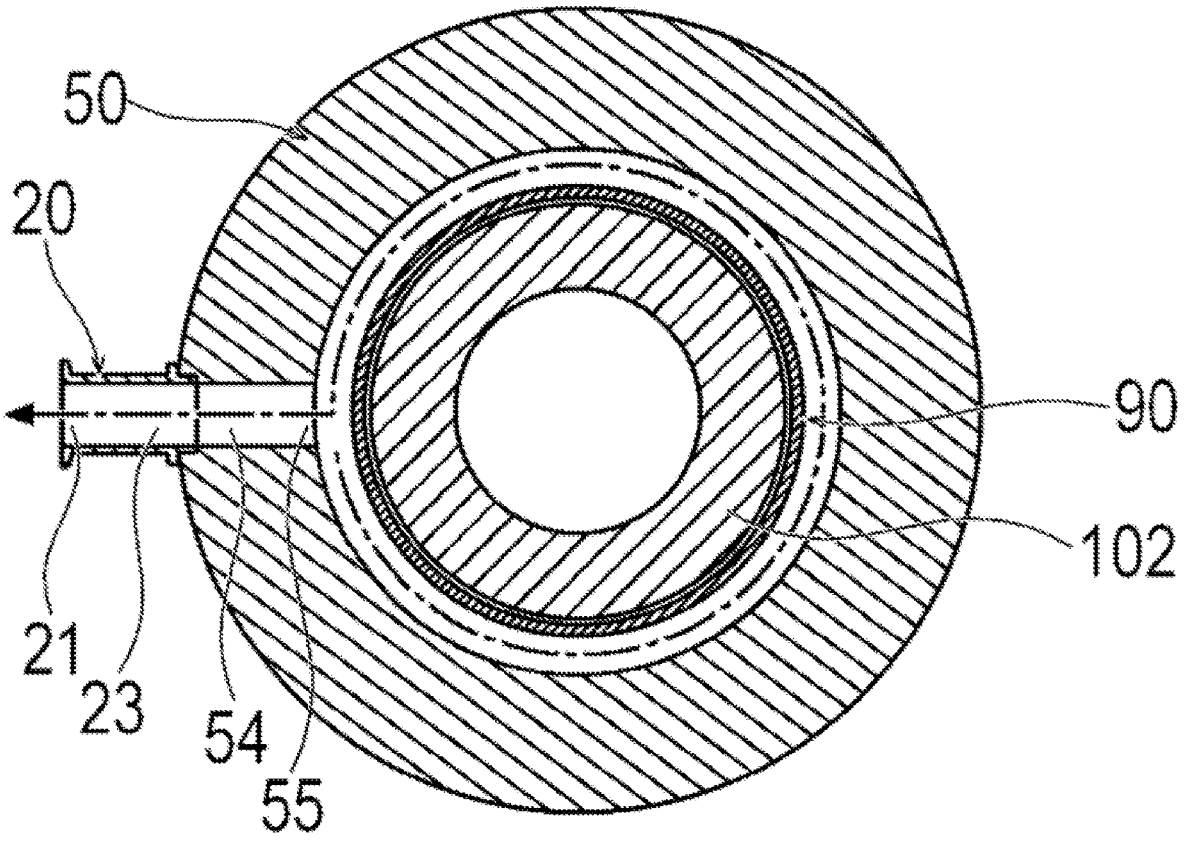
FIG. 2 illustrates a schematic cross section orthogonal to a rotating shaft in the vicinity of a heat insulating wall and an outlet port of the vacuum pump.
Figure 3:
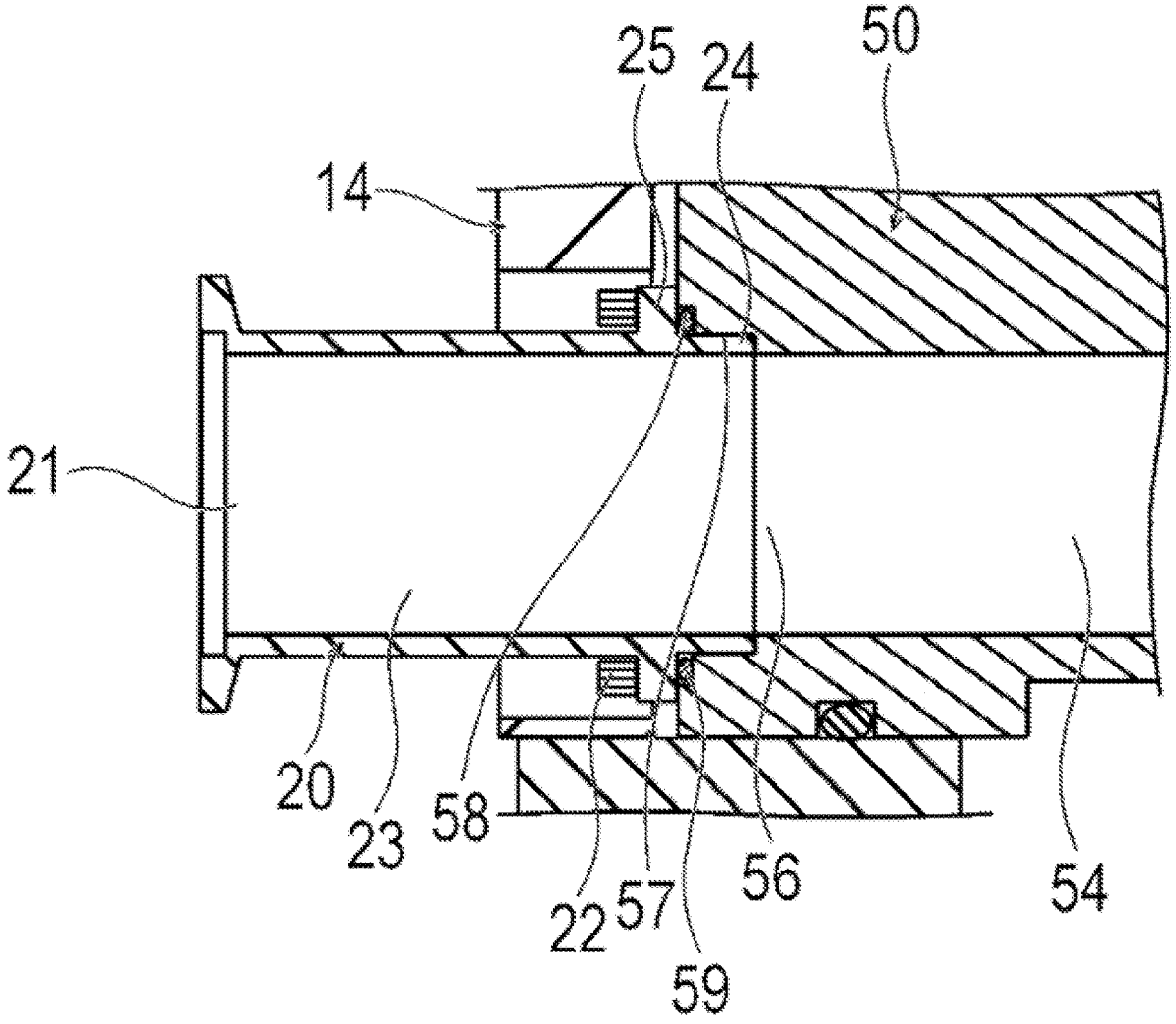
FIG. 3 is a partial cross-sectional view illustrating the vicinity of an outlet pipe and a passage in the first embodiment.

In the thread groove stator 50, one passage 54 penetrating in the radial direction is formed downstream of a part where the thread groove 51 is formed. The member on which the passage 54 is formed is not limited to the thread groove stator 50 as long as it is a member provided downstream of the thread groove 51. As shown in FIGS. 1 to 3, the passage 54 allows the gas that is transferred from the thread groove 51 inside the thread groove stator 50 to flow toward the outlet port 21 provided on the outer side in the radial direction. The passage 54 is formed to have a constant inner diameter, from a passage entrance portion 55 on the inner peripheral side of the thread groove stator 50 to a passage exit portion 56 on the outer peripheral side of the thread groove stator 50. The direction in which the passage 54 extends is orthogonal to the rotating shaft of the rotor 30. The thread groove stator 50 includes, on the outlet port 21 side from the passage exit portion 56, a fitting portion 57 into which the outlet pipe 20 is fitted, and a ring housing portion 58 for housing an O-ring 59 on the outer side of the fitting portion 57 in the radial direction. The inner diameter of the fitting portion 57 is larger than the inner diameter of the passage 54, and the inner diameter of the ring housing portion 58 is larger than the inner diameter of the fitting portion 57.

The outlet pipe 20 is coupled to the thread groove stator 50 by a bolt 22. The outlet pipe 20 includes an outlet pipe passage 23, the outlet port 21 located on the outlet side of the outlet pipe passage 23, an outlet pipe base end portion 24 that fits into the fitting portion 57 of the thread groove stator 50 on the opposite side of the outlet port 21, and an outlet pipe flange 25 that is in contact with an outer peripheral surface of the thread groove stator 50. The outlet port 21 is connected in a communicating manner to an auxiliary pump, not shown. The inner diameter of the outlet pipe passage 23 coincides with the inner diameter of the passage 54. An inner peripheral surface of the outlet pipe passage 23 is smoothly continuous with an inner peripheral surface of the passage 54. The direction in which the outlet pipe passage 23 extends coincides with the direction in which the passage 54 extends, and is orthogonal to the rotating shaft of the rotor 30. The difference between the inner diameter of the outlet pipe passage 23 and the inner diameter of the passage 54 at a boundary between the outlet pipe passage 23 and the passage 54 is preferably as small as possible, such as 0.6 mm or less, preferably 0.4 mm or less, and more preferably 0.2 mm or less. The deviation between the axis of the outlet pipe passage 23 and the axis of the passage 54 at the boundary between the outlet pipe passage 23 and the passage 54 is preferably as small as possible, such as 0.3 mm or less, preferably 0.2 mm or less, and more preferably 0.1 mm or less. The outlet pipe 20 penetrates the water cooling spacer 14 without coming into contact with the water cooling spacer 14. Therefore, the outlet pipe 20 is heated by the thread groove stator 50 that is provided with the cartridge heater 52 and therefore raised to a high temperature. This makes it difficult for by-products to precipitate and accumulate in the outlet pipe 20.

The heat insulating spacer 18 is a heat insulating means for insulating the thread groove stator 50, which becomes hot, and the water cooling spacer 14 from each other. The heat insulating spacer 18 is made of a material having a low thermal conductivity, that is, a material that does not easily transfer heat. The constituent material of the heat insulating spacer 18 is, for example, aluminum, stainless steel, or the like. Further, the heat insulating spacer 18 is disposed in close contact with the plurality of stators 41 on the lower stage side (downstream side), and is separated from an inner peripheral surface of the water cooling spacer 14 coupled to the plurality of stators 41 on the upper stage side (upstream side), with a gap for heat insulation therebetween.

Both the water cooling spacer 14 and the thread groove stator 50 are coupled to a base main body 101 of the base 100 via the heat insulating material 19. Therefore, both the water cooling spacer 14 and the thread groove stator 50 are insulated from the base 100 by the heat insulating material 19.

The base 100 includes the base main body 101 to which the thread groove stator 50 and the water cooling spacer 14 are coupled, and a stator column 102 that protrudes upward (to the upstream side) from the center of the base main body 101. The stator column 102 functions as a stator for the motor 80.

A water cooling pipe 103 is embedded in the base main body 101. The water cooling pipe 103 constantly cools the base main body 101, the stator column 102, a magnetic bearing described later, an auxiliary bearing 65, the motor 80, and the like by having cooling water circulating inside the water cooling pipe 103. In the present embodiment, the water cooling pipe 103 maintains a temperature of 25° C. to 70° C. by causing the cooling water to constantly flow.

Figure 4:
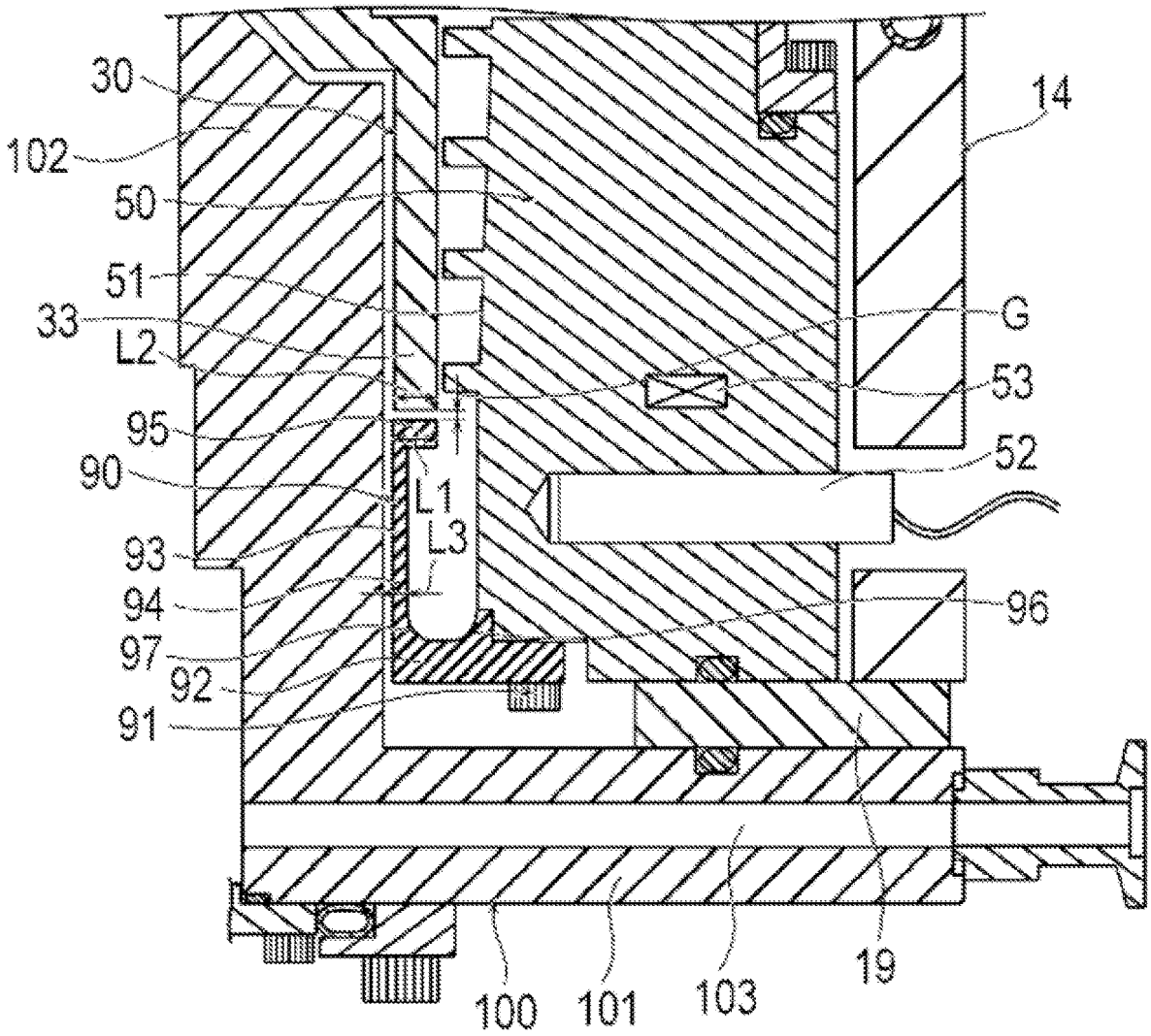
FIG. 4 is a partial cross-sectional view illustrating the vicinity of the heat insulating wall and a thread groove stator in the first embodiment.

As illustrated in FIG. 4, the heat insulating wall 90 is coupled to the downstream-side end surface of the thread groove stator 50 by a bolt 91. The heat insulating wall 90 is thermally connected to the thread groove stator 50 and therefore heated to high temperature. For this reason, the heat insulating wall 90 is preferably made of a material having excellent thermal conductivity. Examples of the material having excellent thermal conductivity include aluminum. The member to which the heat insulating wall 90 is connected does not have to be the thread groove stator 50 as long as it is a member located downstream of the thread groove 51. The member to which the heat insulating wall 90 is coupled is preferably a high temperature portion heated by a heating means (heater) as with the thread groove stator 50. Therefore, for example, when the thread groove stator 50 has a different configuration from the member provided with the heating means, the heat insulating wall 90 may be coupled to the member provided with the heating means. The heat insulating wall 90 covers at least part of the stator column 102 and base main body 101, which are low temperature portions close to the flow path downstream of the thread groove 51. The heat insulating wall 90 restricts the gas downstream of the thread groove 51 from coming into contact with the low temperature stator column 102 and base 100 cooled by the water cooling pipe 103, and suppresses the precipitation and accumulation of by-products in the low temperature portions.

As illustrated in FIG. 2, the heat insulating wall 90 is formed in such a manner that the gas discharged from the thread groove 51 can be transferred to the passage 54 communicating with the outlet port 21 that is provided at one location in the circumferential direction. As illustrated in FIG. 4, the heat insulating wall 90 has a ring-shaped annular portion 92 extending inward in the radial direction from a portion on the downstream side of the thread groove stator 50, and a substantially cylindrical wall portion 93 extending from an inner portion of the annular portion 92 in the radial direction toward the upstream side and forming a flow path on the outer peripheral surface side. The wall portion 93 includes a cylindrical tubular wall portion 94 located on the annular portion 92 side, and a folded portion 95 protruding outward in the radial direction from an upstream-side end portion of the tubular wall portion 94.

The wall portion 93 is separated from an outer peripheral surface of the stator column 102 having a low temperature, with a gap for heat insulation therebetween. An upstream-side end surface of the wall portion 93 faces a downstream-side end surface of the rotor cylinder portion 33 of the rotor 30 in the axial direction. A radial thickness L3 of the tubular wall portion 94 is shorter than a radial thickness L1 of the folded portion 95. Therefore, the tubular wall portion 94 can be made thin while ensuring the radial thickness L3 of the folded portion 95 at an appropriate length. By making the tubular wall portion 94 thin, a wide flow path on the outer side of the tubular wall portion 94 in the radial direction can be secured. Furthermore, since the cross-sectional area of the tubular wall portion 94 that is orthogonal to the rotating shaft of the rotor 30 becomes small, the thermal resistance of the tubular wall portion 94 increases, making it difficult for heat to be transmitted from the annular portion 92 side to the folded portion 95. As a result, the conduction of heat from the heat insulating wall 90 to the rotor 30 can be reduced by limiting the temperature rise of the folded portion 95. Note that the folded portion 95 does not need to be provided.

A third corner portion 96 is formed between the inner peripheral surface (inner peripheral surface of the stator portion 10) of the thread groove stator 50 downstream of the thread groove 51 and an upstream-side surface of the annular portion 92. In addition, a first corner portion 97 is formed between the upstream-side surface of the annular portion 92 and an outer peripheral surface of the wall portion 93. In the cross section passing through the rotating shaft of the rotor 30, the third corner portion 96 and the first corner portion 97 are each formed in an arc-like concave shape (rounded shape) so that the gas does not stagnate easily. The radius of curvature of the third corner portion 96 and the first corner portion 97 is not particularly limited in the cross section passing through the rotating shaft of the rotor 30, but the larger the radius of curvature, the better. In the present embodiment, the radius of curvature is, for example, 5 mm.

A gap portion between the heat insulating wall 90 and the rotor 30 has a non-contact sealing structure. The upstream-side end surface of the wall portion 93 faces the downstream-side end surface of the rotor cylinder portion, with an appropriate gap G therebetween to ensure sealing properties, with an appropriate facing area. For example, the gap G in the axial direction between the upstream-side end surface of the wall portion 93 and the downstream-side end surface of the rotor cylinder portion is approximately 1.5 mm at rest time. Also, for example, in order to form an appropriate facing area, the radial thickness L1 of the upstream-side end surface of the wall portion 93 is approximately 4 mm, and a radial thickness L2 of the downstream-side end surface of the rotor cylinder portion 33 facing the heat insulating wall 90 is approximately 8 mm.

The rotor 30 is disposed rotatably in the casing 11. The rotor 30 includes the shaft 35, multiple stages of rotor blades 32 along the axial direction, and the rotor cylinder portion 33 disposed downstream of the rotor blades 32. The rotor blades 32 are blades that constitute the turbo-molecular pump and draw and exhaust the gas. The plurality of rotor blades 32 in the respective stages are arranged radially in the circumferential direction.

The rotor 30 has a substantially cylindrical shape, wherein the shaft 35 penetrates therethrough and is fixed therein. Each rotor blade 32 is formed so as to be inclined at a predetermined angle from a plane perpendicular to the axial direction of the shaft 35 in order to transfer gas molecules downward by collision. The rotor blades 32 are integrally formed on an outer peripheral surface of the rotor 30. Alternatively, the rotor blades 32 may be fixed to the outer peripheral surface of the rotor 30.

The rotor cylinder portion 33 is disposed downstream of the rotor blades 32 and formed in a cylindrical shape. The rotor cylinder portion 33 is formed so as to project toward the inner peripheral surface of the thread groove stator 50. The rotor cylinder portion 33 is disposed close to the inner peripheral surface of the thread groove stator 50 with a predetermined gap therebetween.

The shaft 35 is disposed at the center of rotation of the rotor 30. The shaft 35 includes a spindle portion 36 in a columnar shape, and a disc-shaped disc 37 disposed below the spindle portion 36. The spindle portion 36 and the disc 37 are made of a high magnetic permeability material (iron or the like) that can be attracted by magnetism. The spindle portion 36 has its position controlled by being attracted by magnetic force of an upstream side radial electromagnet 61 and a downstream side radial electromagnet 62, which will be described later.

The bearing is, for example, a so-called 5-axis controlled magnetic bearing that supports the shaft 35 in a levitated manner and controls the position of the shaft 35. The bearing includes the upstream side radial electromagnet 61 that attracts the upstream side of the spindle portion 36, the downstream side radial electromagnet 62 that attracts the downstream side of the spindle portion 36, axial electromagnets 63A and 63B that attract the disc 37, and the auxiliary bearing 65. The auxiliary bearing 65 comes into contact with the spindle portion 36 when the shaft runout of the rotor 30 becomes large, to prevent the rotor 30 from coming into direct contact with the stator side and being damaged.

The upstream side radial electromagnet 61 includes four electromagnets arranged in pairs on each of two axes orthogonal on the plane perpendicular to the rotating shaft. The downstream side radial electromagnet 62 includes four electromagnets arranged in pairs on each of two axes orthogonal on the plane perpendicular to the rotating shaft. The axial electromagnets 63A and 63B are arranged so as to sandwich the disc 37 from above and below.

The displacement sensor is disposed on the stator column 102 in order to detect a displacement of the rotor 30. The displacement sensor includes an upstream side radial sensor 71, a downstream side radial sensor 72, and an axial sensor 73. The upstream side radial sensor 71 consists of four non-contact type sensors that are arranged in close proximity to and corresponding to the four upstream side radial electromagnets 61. The upstream side radial sensor 71 is configured to detect a radial displacement of an upper portion of the spindle portion 36 of the shaft 35 and transmit a displacement signal of the detected displacement to the controller 3. Examples of the sensor used as the upstream side radial sensor 71 include an inductance sensor and an eddy current sensor.

The downstream side radial sensor 72 consists of four non-contact type sensors arranged in close proximity to and correspondingly to the four downstream side radial electromagnets 62. The downstream side radial sensor 72 is configured to detect a radial displacement of a lower portion of the spindle portion 36 and transmit a displacement signal of the detected displacement to the controller 3. Examples of the sensor used as the downstream side radial sensor 72 include an inductance sensor and an eddy current sensor.

The axial sensor 73 is disposed below the disc 37. The axial sensor 73 is configured to detect an axial displacement of the shaft 35 and transmit a displacement signal of the detected displacement to the controller 3.

On the basis of the displacement signal detected by the upstream side radial sensor 71, the controller 3 controls the excitation of the upstream side radial electromagnet 61 via a compensation circuit having a PID adjustment function, to adjust an upstream-side radial position of the spindle portion 36. This adjustment is performed independently on each of the two axes orthogonal to each other on the plane perpendicular to the rotating shaft.

In addition, on the basis of the displacement signal detected by the downstream side radial sensor 72, the controller controls the excitation of the downstream side radial electromagnet 62 via a compensation circuit having a PID adjustment function, to adjust a downstream-side radial position of the spindle portion 36. This adjustment is performed independently on each of the two axes orthogonal on the plane perpendicular to the rotating shaft.

In addition, on the basis of the displacement signal detected by the axial sensor 73, the controller 3 controls the excitations of the axial electromagnets 63A and 63B. At this moment, the axial electromagnet 63A attracts the disc 37 upward by its magnetic force, and the axial electromagnet 63B attracts the disc 37 downward by its magnetic force. In this manner, the magnetic bearing can magnetically levitate the shaft 35 and rotatably support the shaft 35 in a non-contact manner by appropriately adjusting the magnetic force applied to the shaft 35.

The motor 80 includes a magnetic pole 81 which is a plurality of permanent magnets arranged on the rotor side, and a motor electromagnet 82 disposed on the stator side. A torque component for rotating the shaft 35 is applied to the magnetic pole 81 from the motor electromagnet 82. Accordingly, the rotor 30 is driven to rotate.

Also, the motor 80 is attached with a rotation speed sensor and a motor temperature sensor, which are not shown. The rotation speed sensor and the motor temperature sensor transmit detected results to the controller 3 as detection signals. The controller 3 uses the signals received from the rotation speed sensor and the motor temperature sensor to control the rotation of the shaft 35.

In the vacuum pump main body 2 described above, when the shaft 35 is driven by the motor 80, the rotor blades 32 and the rotor cylinder portion 33 rotate. As a result, the gas from the chamber is sucked in through the inlet port 12 by the action of the rotor blades 32 and the stator blades 43.

The gas sucked in from the inlet port 12 is transferred between the rotor cylinder portion and the thread groove stator 50 by the rotor blades 32 and the stator blades 43. At this moment, the temperature of the rotor blades 32 rises due to the frictional heat caused when the gas comes into contact with the rotor blades 32, the conduction of the heat generated by the motor 80, or the like. However, this heat is transmitted toward the stator blades 43 by radiation or conduction by gas molecules of the gas or the like. In addition, the stator spacers 42 are joined to each other at an outer peripheral portion. Therefore, the heat received by the stator blades 43 from the rotor blades 32, the frictional heat generated when the gas comes into contact with the stator blades 43, and the like are transmitted to the outside via the stator spacers 42.

Furthermore, the gas transferred between the rotor cylinder portion 33 and the thread groove stator 50 is transferred to the downstream side by the thread groove 51 of the thread groove stator 50. The thread groove stator 50 is heated by the cartridge heater 52. As a result, the thread groove 51 where by-products are likely to precipitate and accumulate at low temperatures is maintained at a high temperature, and the precipitation and accumulation of by-products in the thread groove 51 are suppressed. Therefore, it is possible to prevent the flow path of the thread groove 51 from being narrowed by the by-products.

Also, in order to prevent the gas drawn in from the inlet port 12 from entering electrical parts constituted by the motor 80, the downstream side radial electromagnet 62, the downstream side radial sensor 72, the upstream side radial electromagnet 61, the upstream side radial sensor 71, and the like, the outer periphery of the electrical parts is covered with the stator column 102. The inside of the stator column 102 surrounding the electrical parts is maintained at a predetermined pressure by a purge gas. A pipe, not shown, is disposed in the stator column 102, and the purge gas is introduced through this pipe. The introduced purge gas is sent to the outlet port 21 through the gaps between the auxiliary bearing 65 and the shaft 35, between the motor 80, and between the stator column 102 and the rotor blades 32.

The base main body 101 is cooled by the water cooling pipe 103. As a result, the base main body 101, the stator column 102 thermally connected to the base main body 101, the magnetic bearing, the auxiliary bearing 65, the motor 80, and the like are constantly cooled. Consequently, the gas is prevented from adhering and accumulating inside the vacuum pump main body 2.

As illustrated in FIGS. 2 and 4, the gas transferred to the downstream side of the thread groove 51 is restricted from moving downward by the ring-shaped heat insulating wall 90 fixed to the downstream side of the thread groove stator 50, and is transferred to the passage entrance portion 55 of the thread groove stator 50 that is provided at one location in the circumferential direction. The heat insulating wall 90 covers the low temperature stator column 102 and base main body 101 that are disposed close to the flow path downstream of the thread groove 51. Thus, the heat insulating wall 90 restricts the gas downstream of the thread groove 51 from coming into contact with the low temperature stator column 102 and base 100, suppressing the precipitation and accumulation of by-products in the low temperature portions. In the cross section passing through the rotating shaft of the rotor 30, the third corner portion 96 and the first corner portion 97 of the heat insulating wall 90 are each formed in an arc-like concave shape. Therefore, stagnation of the flow is less likely to occur in the third corner portion 96 and the first corner portion 97, suppressing the precipitation and accumulation of by-products in the third corner portion 96 and the first corner portion 97. In addition, since the heat insulating wall 90 is thermally connected to the thread groove stator 50 and heated to a high temperature, the precipitation and accumulation of by-products are further suppressed.

Furthermore, since the upstream-side end surface of the heat insulating wall 90 and the downstream-side end surface of the rotor cylinder portion 33 of the rotor 30 face each other with the appropriate gap G and an appropriate facing area, appropriate sealing properties are ensured. Therefore, the gas does not reach the stator column 102, the base main body 101, the inside of the stator column 102, and the like from the gap G between the heat insulating wall 90 and the rotor cylinder portion 33, suppressing the precipitation and accumulation of by-products.

As illustrated in FIGS. 1 to 3, the gas transferred to the passage entrance portion 55 reaches the outlet pipe 20 through the passage 54 and is exhausted to the outside from the outlet port 21 of the outlet pipe 20. The passage 54 of the thread groove stator 50 and the outlet pipe passage 23 are formed in a smooth, continuous manner. Accordingly, the flow becomes less likely to stagnate between the passage entrance portion 55 and the outlet port 21, thereby suppressing the precipitation and accumulation of by-products.

Second Embodiment

Figure 5:
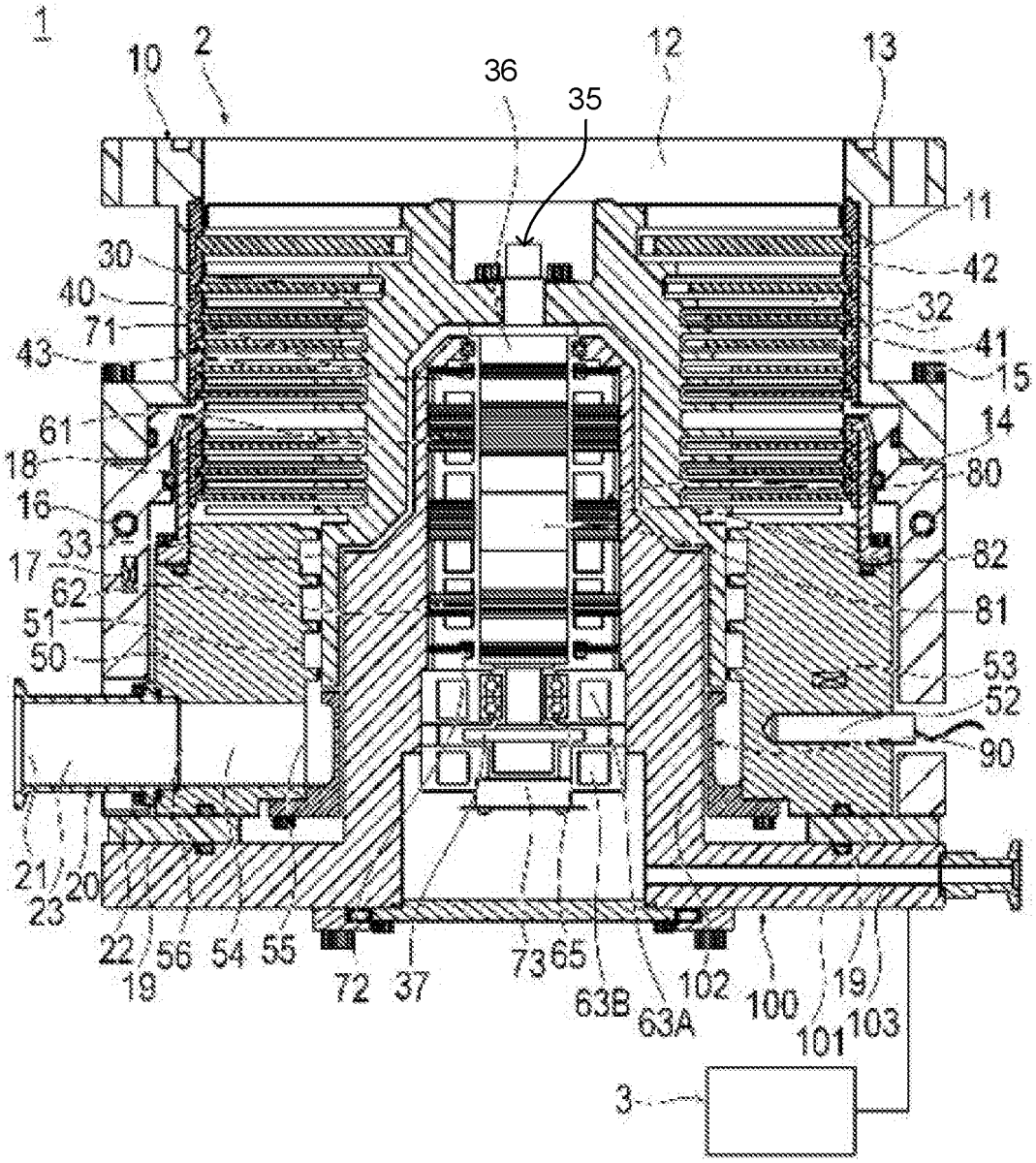
FIG. 5 is a cross-sectional view illustrating a vacuum pump according to a second embodiment.
Figure 6:
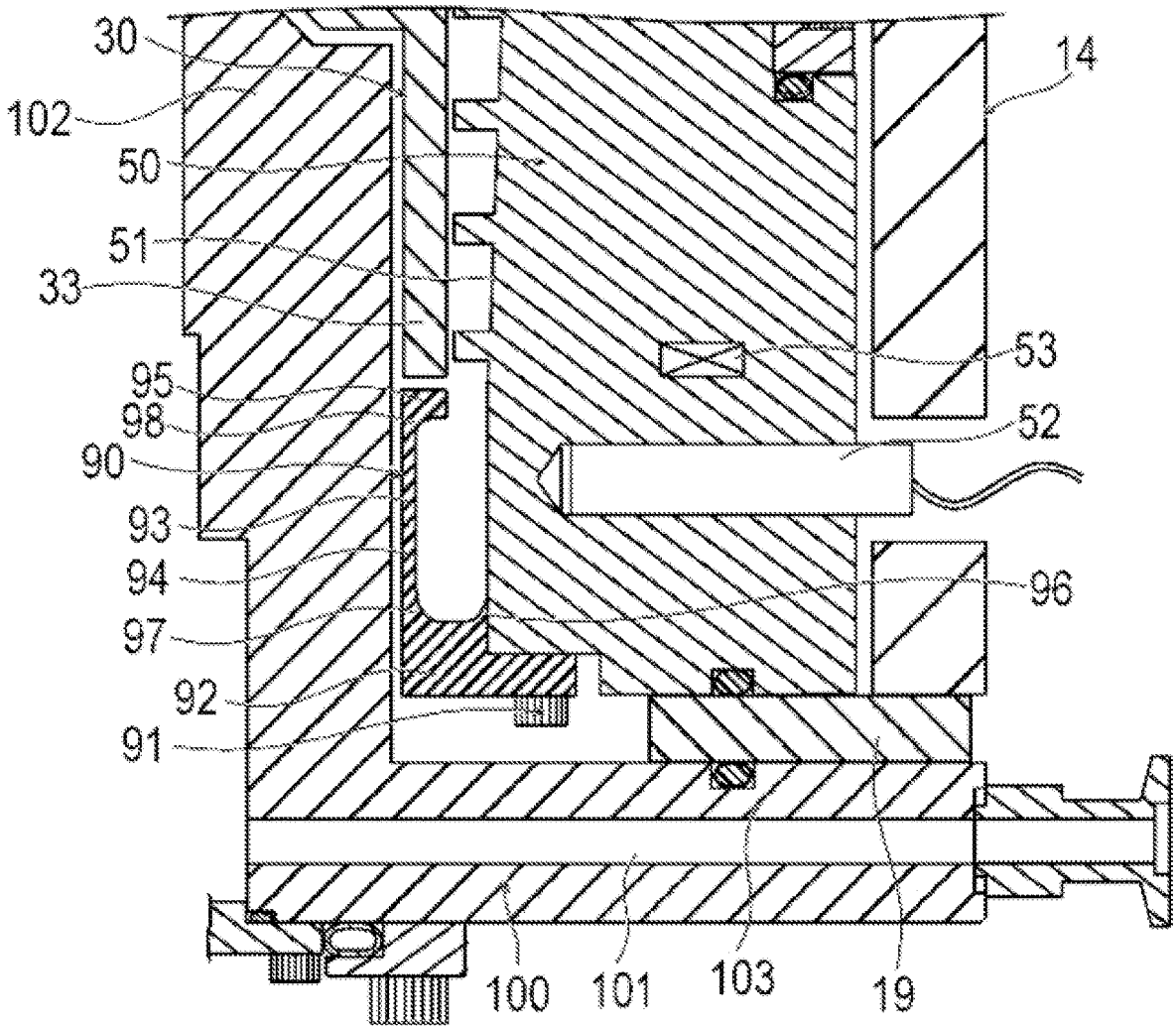
FIG. 6 is a partial cross-sectional view illustrating the vicinity of a heat insulating wall and a thread groove stator in the second embodiment.
Figure 7:
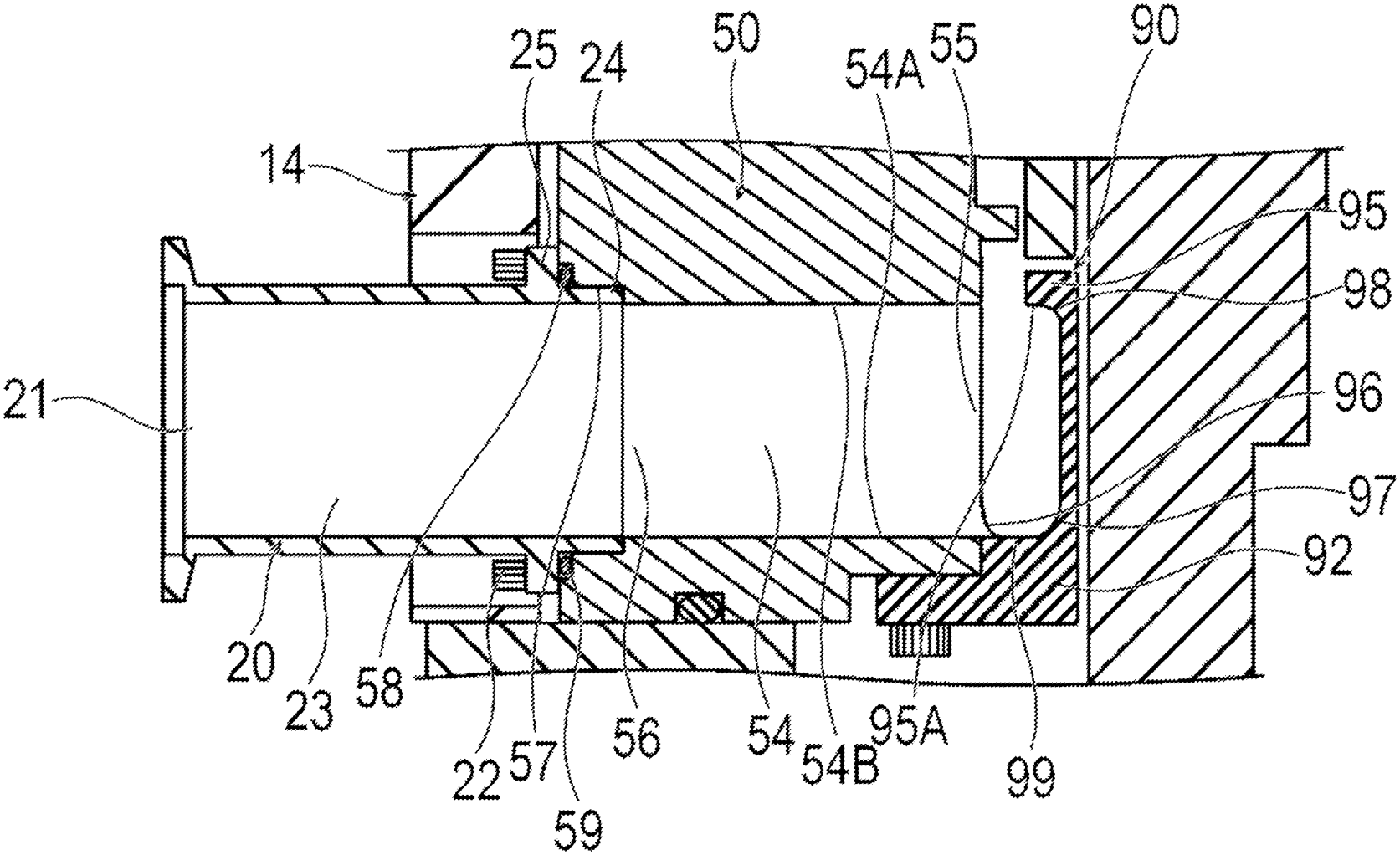
FIG. 7 is a partial cross-sectional view illustrating the vicinity of an outlet pipe and a passage in the second embodiment.

As illustrated in FIGS. 5 to 7, the vacuum pump 1 according to a second embodiment of the present invention differs from that of the first embodiment only in the shapes of the heat insulating wall 90 and the thread groove stator 50.

In the heat insulating wall 90, a second corner portion 98 is formed between an outer peripheral surface of the tubular wall portion 94 and a downstream-side surface of the folded portion 95. The second corner portion 98 is formed in an arc-like concave shape in the cross section passing through the rotating shaft of the rotor 30. Therefore, when the gas transferred from the thread groove 51 flows in the circumferential direction along the heat insulating wall 90, the flow becomes less likely to stagnate at the second corner portion 98. This suppresses the precipitation and accumulation of by-products in the second corner portion 98. The radius of curvature of the second corner portion 98 is not particularly limited, but the larger the radius of curvature, the better. In the present embodiment, the radius of curvature is, for example, 2 mm.

As illustrated in FIG. 7, in the thread groove stator 50, the position of a downstream-side inner wall surface 54A of an inner wall surface of the passage 54 coincides with the position of an innermost portion 99 located on the most downstream side between the third corner portion 96 and the first corner portion 97 (the side opposite to the side where the inlet port 12 is provided along the axial direction), in the axial direction. Therefore, the passage entrance portion 55 of the thread groove stator 50 penetrates the third corner portion 96 and smoothly continues to the innermost portion 99. Therefore, the gas flowing in the circumferential direction along the heat insulating wall 90 can smoothly enter the passage 54 of the thread groove stator 50 and smoothly flow to the outlet port 21. Accordingly, the precipitation and accumulation of by-products are suppressed in the vicinity of the passage entrance portion 55. As with the first embodiment, the third corner portion 96 is formed in the heat insulating wall 90, except for a portion communicating with the passage entrance portion 55 in the circumferential direction. As a modification, the third corner portion 96 other than the portion communicating with the passage entrance portion 55 in the circumferential direction of the heat insulating wall 90 does not have to be in an arc shape in the cross section passing through the rotating shaft of the rotor 30, and may have a concave shape in which the radius of curvature is approximately 0.

Further, in the thread groove stator 50, the position of an upstream-side inner wall surface 54B of the inner wall surface of the passage 54 coincides with the position of a downstream-side surface 95A of the folded portion 95, in the axial direction. Therefore, the gas flowing in the circumferential direction along the heat insulating wall 90 can smoothly enter the passage 54 of the thread groove stator 50 from the flow path between the second corner portion 98 of the folded portion 95 and the first corner portion 97 of the annular portion 92, and smoothly flow to the outlet port 21. Accordingly, the precipitation and accumulation of by-products are suppressed in the vicinity of the passage entrance portion 55.

The present invention is not limited to the embodiments described above, and various modifications can be made by those skilled in the art within the technical idea of the present invention. For example, the bearing does not have to be a magnetic bearing. Also, the outlet port 21 may be formed in the casing 11. In addition, both the inlet port 12 and the outlet port 21 may be formed in the casing 11.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a casing that includes an inlet port for drawing gas from outside or an outlet port for discharging gas to outside;

a rotor that is rotatably disposed in the casing and provided with a plurality of rotor blades and a rotor cylinder portion downstream of the plurality of rotor blades;

a driving portion that drives the rotor to rotate;

a bearing that rotatably supports the rotor;

stator blades that are arranged so as to alternate with the plurality of rotor blades in an axial direction of the rotor;

a thread groove stator that is disposed downstream of the stator blades and has an inner peripheral surface facing an outer peripheral surface of the rotor cylinder portion; and a heat insulating wall that is disposed downstream of a thread groove formed on the outer peripheral surface of the rotor cylinder portion or the inner peripheral surface of the thread groove stator, wherein the heat insulating wall includes a ring-shaped annular portion and a wall portion in a cylindrical shape that extends from an inner portion of the annular portion in a radial direction to an upstream side and forms a flow path on an outer peripheral surface side, a first corner portion is formed between an upstream-side surface of the annular portion and an outer peripheral surface of the wall portion, the first corner portion being formed in an arc shape in a cross section passing through a rotating shaft of the rotor, and a third corner portion is formed between the inner peripheral surface of the thread groove stator or a member coupled to the thread groove stator and the upstream-side surface of the annular portion, the third corner portion being formed in an arc shape in the cross section passing through the rotating shaft of the rotor.

2. The vacuum pump according to claim 1, wherein the wall portion includes a tubular wall portion having a cylindrical shape, and a ring-shaped folded portion protruding outward in the radial direction from an upstream-side end portion of the tubular wall portion.

3. The vacuum pump according to claim 2, wherein, in a cross section passing through the rotating shaft of the rotor, a second corner portion is formed between an outer peripheral surface of the tubular wall portion and a downstream-side surface of the folded portion, the second corner portion having an arc shape.

4. The vacuum pump according to claim 1, wherein the casing includes a passage formed downstream of the heat insulating wall and an outlet pipe having a cylindrical shape in which the outlet port is formed, and an inner wall surface of the passage and an inner wall surface of the outlet pipe are formed in a smooth, continuous manner.

5. The vacuum pump according to claim 1, wherein the heat insulating wall is disposed so as to cover a low temperature portion of the casing that is disposed downstream of the heat insulating wall and/or on an inner side of the heat insulating wall in the radial direction, and has a temperature lower than that of the heat insulating wall.

6. The vacuum pump according to claim 1, wherein the thread groove stator or the member coupled to the thread groove stator includes a heater, and the heat insulating wall is coupled to the thread groove stator or the member coupled to the thread groove stator and having the heater disposed therein.

7. The vacuum pump according to claim 1, wherein an upstream-side end surface of the wall portion faces a downstream-side end surface of the rotor cylinder portion in the axial direction.

* * * * *